US006080536A

United States Patent [19]

Elst et al.

[11] Patent Number: 6,080,536

[45] Date of Patent: Jun. 27, 2000

[54] METHOD OF PREPARING (100) TABULAR GRAINS RICH IN SILVER BROMIDE

[75] Inventors: Kathy Elst, Kessel; Eddy Michiels, Lichtaart, both of Belgium; Günter Helling, Odenthal, Germany

[73] Assignee: Agfa-Gevaert, N.V., Mortsel, Belgium

[21] Appl. No.: 09/267,635

[22] Filed: Mar. 15, 1999

Related U.S. Application Data

[60] Provisional application No. 60/081,762, Apr. 15, 1998.

[30] Foreign Application Priority Data

Mar. 23, 1998 [EP] European Pat. Off. ..... 98200901

[51] Int. Cl.[7] ..... G03C 1/015; G03C 1/005; G03C 1/047; G03C 1/053

[52] U.S. Cl. ..... 430/567; 430/569; 430/637; 430/642; 430/966

[58] Field of Search ..... 430/567, 569, 430/642, 637, 966

[56] References Cited

U.S. PATENT DOCUMENTS

| | | | |
|---|---|---|---|
| 4,063,951 | 12/1977 | Bogg | 430/569 |
| 4,386,156 | 5/1983 | Mignot | 430/567 |
| 5,215,879 | 6/1993 | Suzuki et al. | 430/569 |
| 5,455,154 | 10/1995 | Helling et al. | 430/536 |
| 5,565,314 | 10/1996 | Nakatsu et al. | 430/567 |
| 5,726,006 | 3/1998 | Gourlaouen et al. | 430/567 |
| 5,879,873 | 3/1999 | Gourlaouen et al. | 430/569 |

*Primary Examiner*—Mark F. Huff
*Attorney, Agent, or Firm*—Breiner & Breiner

[57] ABSTRACT

A method has been described of preparing a photosensitive emulsion comprising tabular silver halide grains rich in silver bromide, having {100} major faces and an aspect ratio more than 1.5, wherein at least 50% of the projected area of all grains is provided by said {100} tabular grains, said method comprising the step of running in a reaction vessel an aqueous silver salt solution and an aqueous alkali halide solution rich in alkali bromide, characterized in that before starting running said reaction vessel comprises in an aqueous solution of gelatin an amount of amino-modified polyvinyl alcohol as an aqueous soluble polymer.

8 Claims, 1 Drawing Sheet

METHOD OF PREPARING (100) TABULAR GRAINS RICH IN SILVER BROMIDE

This application claims the benefit of U.S. Provisional Application Ser. No. 60/081,762 filed Apr. 15, 1998.

FIELD OF THE INVENTION

The present invention relates to a method of preparing photosensitive emulsion grains having {100} tabular emulsion crystals rich in silver bromide.

BACKGROUND OF THE INVENTION

The use of tabular grains in photographic industry is becoming more important for many applications. The most important reason why tabular grains are so preferred nowadays is their inherent property of having an increased ratio of surface area to volume ratio. This ratio has a positive influence on the effectiveness of the spectral sensitization which is caused by a better interaction between spectral sensitizer and silver halide grain. Moreover an enhanced spectral sensitivity resulting therefrom is deteriorated to a lesser extent by desensitization occurring when adding an increased concentration of the spectral sensitizer, which may occur to a significant extent with other types of grains. Another desired effect resulting from the shape of the tabular grain is its increased covering power which is observed after processing and which is the result of an increased surface for the same crystal volume. As a consequence the possibility of coating thinner emulsion layers with lower amounts of silver is offered.

The type of tabular grain that is used can also play an important role in a lot of different applications. If silver bromide crystals are grown at a high bromide ion excess with respect to the presence of silver ions, tabular grains are easily formed. The anisotropic growth habit that is experienced is due to the presence of usually two or three twin planes parallel to a (111) plane as published by Berriman et al. in Nature, Vol.180(1957), p.293 and J. Hamilton et al. in J. Appl. Phys., Vol.35(1964), p.414.

A first model proposed by D. Hamilton et al in J. Appl. Phys., Vol.31(1960), p.1165 assumes that all side faces are composed of (111) planes forming ridges and re-entrant grooves at the twin planes. The re-entrant grooves are sites where the nucleation of a new layer occurs more easily, thus promoting tabular growth.

In the last decade some investigators suggested that the side faces should not necessarily have to consist entirely of (111) planes. Therefor another model was proposed by G. J. Bögels et al. in Acta Cryst., Vol.A53(1997), p.84, which was based on the assumption that the side faces can be composed of (111) as well as of (100) parts and that the transition between the two occurs at the twin boundaries. The tabular growth originates from faster growth on the side plane of a (100) plane than a (111) plane as this results in the creation of a substep at the twin boundary. As the top and bottom planes which still are entirely (111) planes are growing slower, two dimensional growth is induced. Opposite to the chemical ripening of {111} tabular grain emulsions wherein huge amounts of spectral sensitizing dyes should be added before addition of chemical ripening agents and starting chemical ripening in order to provide site-directed introduction of sensitivity specks, {100} tabular grains don't require the measures mentioned hereinbefore as for the said {100} tabular grains chemical and spectral sensitization are perfectly disconnectable.

The first publications on tabular grains bounded by {100} parallel major faces were related with silver iodobromide emulsions. Bogg in U.S. Pat. No. 4,063,951 and Mignot in U.S. Pat. No. 4,386,156 were the first and most important publications. Practically all following patents like e.g. EP-A's 0 534 395; 0 569 971; 0 584 815; 0 584 644; 0 602 878; 0 616 255; 0 617 317; 0 617 320; 0 617 321; 0 617 325; 0 618 492; 0 618 493; 0 653 659 and 0 653 669; U.S. Pat. Nos. 5,024,931; 5,264,337; 5,275,930; 5,292,632; 5,310,635; 5,314,798; 5,320,938; 5,356,764; 5,601,967; and WO-Applications 94/22051 and 94/22054 are related with {100} tabular emulsion grains predominantly rich in chloride and a process for preparing them wherein the tabular grain fraction showing {100} major faces is significant. The fact that research has recently been predominantly directed to silver chloride {100} tabular grains rich in silver chloride is clearly related with lack for a stabilizer, required in the stabilization by a "habit modifying agent" of the flat crystal faces of {111} tabular grains: its absence means that no problematic interactions between said stabilizer and a chemical or spectral sensitizer occur.

Profit is further taken from the already mentioned separation of chemical and spectral sensitization mechanisms, but it is clear that optimization and reproduction of chemical and spectral sensitization highly depends on the presence of a large number of tabular {100} crystals covering a high percentage amount of the total projected area of all grains in the whole emulsion crystal population as crystals having a habit differing therefrom (as e.g. small globular crystals which may be unreproducibly present therein) may take away unreproducible amounts of chemically and spectrally sensitizing agents.

Further developments in order to provide practically useful tabular {100} silver halide emulsions having large amounts of {100} crystals or grains are thus remaining of interest.

OBJECTS OF THE INVENTION

It is therefore an object of the present invention to provide a silver halide emulsion comprising {100} tabular silver halide grains, covering a high percentage amount of the total projected area of all grains.

Further objects and advantages of the invention will become apparent from the description hereinafter.

SUMMARY OF THE INVENTION

As will be shown in the detailed description and in the Examples hereinafter the above mentioned objects are realized by providing a method of preparing a photosensitive emulsion comprising tabular silver halide grains rich in silver bromide, having {100} major faces and an aspect ratio more than 1.5, wherein at least 50% of the projected area of all grains is provided by said {100} tabular grains, said method comprising the step of running in a reaction vessel an aqueous silver salt solution and an aqueous alkali halide solution rich in alkali bromide, characterized in that before starting running the said reaction vessel comprises in an aqueous solution of gelatin an amount of amino-modified polyvinyl alcohol.

DETAILED DESCRIPTION OF THE INVENTION

Figure 1:
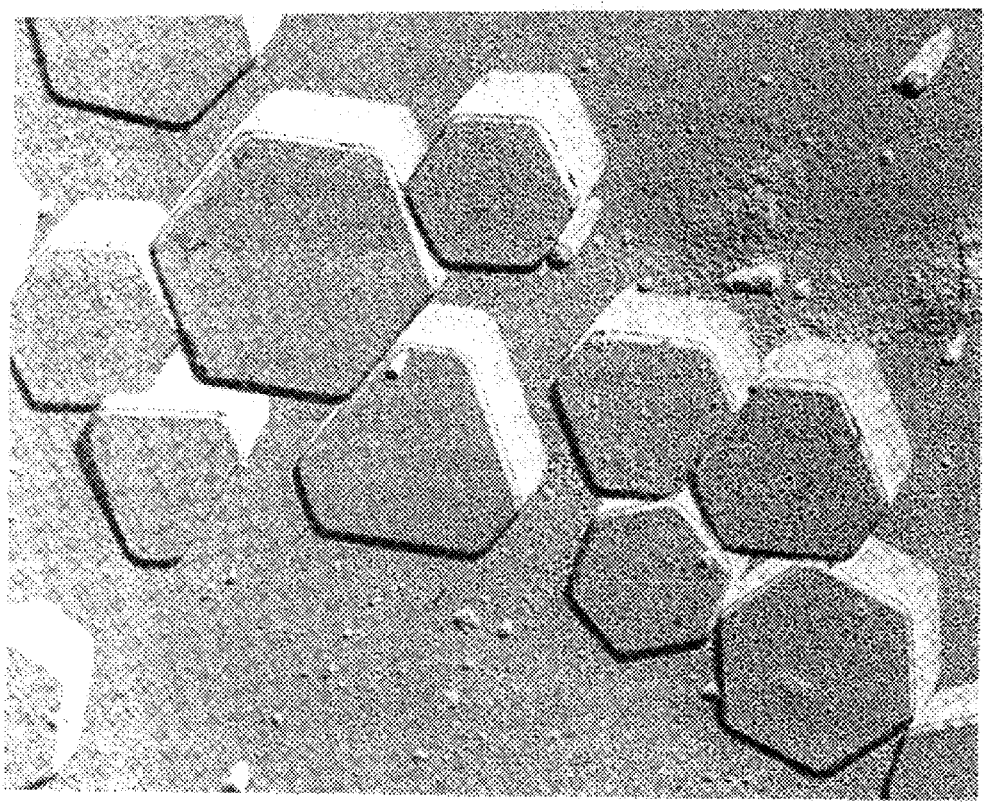

While the present invention will hereinafter be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appending claims Within the context of the present invention it is of utmost importance to start the preparation of the desired emulsion crystals in an aqueous dispersion medium of gelatin wherein an amount of amino-modified polyvinyl alcohol as an aqueous soluble polymer is initially dissolved. According to the method of the present invention it is preferred that the ratio by weight of the said amino-modified polyvinyl alcohol to gelatin is at least 1:5 and even more preferably at least 1:3, wherein an upper limit of said ratio is 1:1. A minimum amount of at least 1:5 or about 20% versus gelatin is required in order to get the preferred tabular {100} crystal habit and in order to get the desired high coverage of the total projected area of all emulsion grains by {100} tabular grains having grain characteristics as set forth being an aspect ratio more than 1.5, wherein at least 50% of the projected area of all grains is provided by said {100} tabular grains. It is of utmost importance for the said amino-modified polyvinyl alcohol to be present in the reaction vessel before starting any precipitation step wherein grains are formed, opposite to e.g. the method described in U.S. Pat. No. 5,215,879 wherein a water-soluble polymer is introduced after having formed silver halide nuclear grains by mixing a water soluble silver salt and a water soluble halide, thus in the course of carrying out an Ostwald ripening step. The term "aspect ratio" mentioned hereinbefore is well-known by anyone skilled in the art and is defined by the average ratio of the ratio obtained for all tabular grains, calculated from the ratio of surface area and thickness of each individual tabular {100} crystal or grain.

Polyvinyl alcohol is well-known as a hydrophilic colloid, being well soluble in aqueous solutions, but according to the method of the present invention amino-modified polyvinyl alcohol is used in the reaction vessel as hydrophilic colloid besides gelatin. Said amino-modified polyvinyl alcohol is modified in such a way that the ratio by weight of vinylacetalamine dimethylacetal to vinylalcohol in the hydrophilic polymer is from 1:20 up to 1:1 and more preferably from 1:10 up to 1:2. The general structure of said amino modified polymer chain is represented hereinafter in the formula (I), wherein side chains of the main vinyl chain represent as functions alcohol, acetalamine or aminoacetaldehyde dimethylacetal and acetate and wherein said side chains are variable in ratio amounts as set forth hereinbefore.

(I)

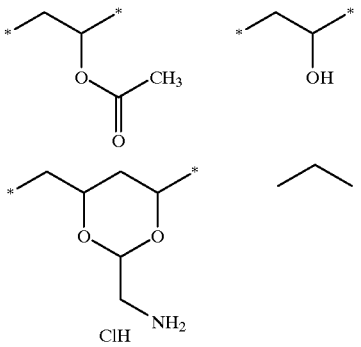

According to the method of the present invention it is further preferred to provide oxidized gelatin as hydrophilic colloid in the reaction vessel, wherein said oxidized gelatin has methionine in an amount of less than 30 μmoles per mole of gelatin. In order to determine the methionine content of gelatin many references from literature are available as e.g. in J. Phot. Sc., Vol. 28(1980), p.111–118 wherein as most obvious reducing substances in gelatin methionine residues of the macromolecule are determined in reaction with Au(III)-ions. The so-called "gold number" permits determination of amounts of methionine in the gelatin following the rule that 1 μmole of Au corresponds with 1.6 μmole of methionine. In J. Phot. Sc., Vol. 33(1989), p.10–17 the methionine content was determined using the gaschromatographic procedure developed by Apostolatos and Hoff (Anal. Biochem. Vol. 118(1981), p.126) and applied to gelatin by Rose and Kaplan. In this article calorimetry is used in a quantitative procedure for determining methionine (constant over initial pH range examined: 3.0–8.0). In J. Phot. Sc., Vol. 40(1992), p.149–151 amounts of methionine, methionine sulphoxide and methionine sulphone are determined by a chromatographic technique for amino acids (Hitachi Amino Acid Analyser), whereas in J. Phot. Sc., Vol. 41(1993), p.172–175 these compounds are determined by HPLC. In J. Phot. Sc., Vol.39(1995), p. 367–372 it has been established that a good correlation between methionine content determined by Rose and Kaplan making use of gas chromatographic techniques (4th IAG Conference, Fribourg 1985, Amman-Brass & Pouradier) and the Scatchard technique (described in J. Phot. Sc., Vol. 42(1994), p.117–119) can be found. In the said technique the interaction at pH=3.0 of $Ag^+$ and gelatin is determined by means of potential measurements of free $Ag^+$-ions.

After preparing in a reaction vessel a dispersion medium containing gelatin having less than 30 umoles (corresponding with less than 4000 ppm of methionine per gram of gelatin (having an average molecular weight of about 100000) and amino-modified polyvinyl alcohol as set forth hereinbefore, according to the method of the present invention, a total amount of silver nitrate of less than 10% by weight, and more preferably 0.5% to 5.0%, is added during a nucleation step which preferably consists of an approximately equimolecular simultaneous addition (e.g. by the so-called double jet technique) of silver nitrate and halide salts at a pBr of 1.0 to 2.5. In order to provide a suitable medium wherein nucleation can take place, pBr is adjusted in the reaction vessel before nucleation at a value of from 2.0 to 2.5 and the vessel is acidified to a pH value of between 1.5 and 3.0.

The rest of the silver nitrate and halide salts is added during one or more consecutive double jet growth step(s), separated from each other by several physical ripening steps. During one or more of said steps the temperature of the reaction vessel, which was initially set at a lower level during nucleation (e.g. between 45° C. and 55° C.), is increased to a temperature within the interval of 60–80° C., and more preferably between 65 and 75° C. Said temperature increase is normally performed between the nucleation step and the first growth step. Within those two steps addition of further amounts of gelatin is normally performed in order to provide sufficient protective action in the colloidal medium of the growing tabular silver halide nuclei. Said gelatin is not as critical as the one added to the reaction vessel before starting nucleation and may be the same oxidized gelatin or normally used non-oxidized gelatin having 30 or more μmoles of methionine per gram or even modified gelatin as e.g. phthalated gelatin.

Further, according to the method of the present invention, growing said silver halide crystal nuclei proceeds by precipitation of silver halide by means of double-jet precipitation of an aqueous silver nitrate solution and an aqueous solution comprising halide ions, wherein more than 90% and more preferably up to 95% by weight of the total amount of silver nitrate is consumed.

The different steps of the precipitation can be alternated by physical ripening steps as already suggested hereinbefore or by so called "neutralization steps", during which the pAg (pBr) value is changed to a value required in the next growth step by adding an amount of silver nitrate solution or a water soluble halide salt within a well-defined time of addition by means of the single-jet technique. Alternative ways to regulate the pAg to the desired value before continuing the processing are diluting the emulsion present in the reaction vessel, diafiltration or ultrafiltration and even flocculation and washing procedures, the last techniques being preferred in order to concentrate the emulsion crystals in the reaction vessel. Any combination or any choice of the mentioned techniques may be applied thereto.

The {100} tabular grains rich in silver bromide at the end of the preparation according to the method of the present invention exhibit an average aspect ratio of at least 1.5:1, more preferably of at least 2:1 and even more preferably of at least 5:1, and wherein {100} tabular grains rich in silver bromide represent a projected area of all grains of at least 50%, more preferably at least 70% and in an optimized preparation method even up to at least 90%. Said {100} tabular grains rich in silver bromide having been prepared by the steps of precipitating in a reaction vessel with an aqueous silver salt solution and an aqueous alkali halide solution rich in alkali bromide are further composed of silver bromide, silver bromoiodide, silver bromochloride or silver bromochloroiodide, wherein iodide, if present, represents a percentage molar amount of up to 3 mole % and wherein chloride, if present, represents a percentage molar amount of up to 10 mole %. According to the desired composition, halides differing from bromide are thus added to the reaction vessels at differing steps, depending on the requirement to have a homogeneous or a heterogeneous distribution of the said ions differing from bromide in the crystal volume of the {100} tabular crystal formed. So silver halide differing from silver bromide can be found in one or more internal zones, e.g. in rings, or at the surface of the crystal. At the grain surface it may be localized as an epitaxially protruding (often cubic) microcrystal in contact with the host grain or as a consequence of conversion, wherein, especially in the case of {100} tabular grains rich in silver bromide silver iodide may be enriched at the surface, providing a variable iodide profile thereof.

Iodide ions are normally provided by addition of alkali iodide salts or aqueous solution therefrom as e.g. potassium iodide to the reaction vessel, wherein as an alternative iodide may be provided by means of an iodide releasing agent. Patent Applications referring to methods wherein iodide releasing agents are used are e.g. EP-A's 0 563 701, 0 563 708, 0 561 415 and 0 651 284. Preparation of silver bromoiodide emulsion crystals can be achieved by mixing a soluble bromide and a soluble iodide salt in one or more of the halide solutions up to the desired mole % concentrations required in each preparation step or by a triple jet technique, or separate addition of an iodide containing aqueous solution. Due to the lower solubility of silver iodide in comparison with silver bromide, said iodide ions are able to displace bromide ions from the grain, a technique known in the art as conversion. Iodide ions may also be incorporated into the silver halide crystal lattice by the addition of a previously prepared silver iodide micrate emulsion, composed of either pure silver iodide or mixed halides, but as already set forth hereinbefore in a preferred embodiment iodide releasing agents are used, at least partially, e.g. in one or more conversion steps during or at the end of the precipitation. Even bromide releasing agents are not excluded in the precipitation steps according to the method of this invention.

Said {100} tabular grains rich in silver bromide, prepared according to the method of the present invention, further have an average thickness of less than 0.30 $\mu$m, and more preferably between 0.10 and 0.20 $\mu$m, and a coefficient of variation of the grain size distribution of the {100} tabular grains of less than 0.40 and more preferably between 0.10 and 0.30.

During the growth step(s) an increasing flow rate of silver and halide solutions is preferably applied, e.g. a linearly increasing flow rate. Typically the flow rate at the end is about 3 to 10 times greater then at the start of the growth step, wherein the flow rate or addition rate of silver nitrate solutions is performed as programmed before, whereas the flow rate of solutions rich in alkali bromide are run in a variable way as a function of the required pBr or pAg in the reaction vessel at the moment of precipitation. For a succesful preparation of emulsions having tabular grains rich in silver bromide according to the method of the present invention the pBr before the start and during the different stages of the precipitation is maintained at well-defined values which may be variable from step to step and which may be varied by neutralization steps inbetween as will become apparent from the examples hereinafter.

It is possible in the method of the present invention to prepare nuclei in a separate vessel and to grow the said nuclei in another vessel. As an alternative growth of the nuclei formed in the nucleation step may be provided by addition of microcrystals having differing compositions in the differing growth steps.

At the end of the precipitation, the emulsion vessel thus contains a {100} tabular grain emulsion rich in silver bromide and high amounts of aqueous soluble salts (especially if no microcrystals were added as an alternative during growth). Therefore, after completion of the precipitation a wash technique in order to remove the excess of soluble salts may be applied at a pH value which can vary during washing. If in that case the emulsion is washed by diafiltration by means of a semipermeable membrane. This technique is also called ultrafiltration. Such procedures are disclosed e.g. in Research Disclosure Vol. 102, Oct. 1972, Item 10208, Research Disclosure Vol. 131, March, Item 13122 and Mignot U.S. Pat. No. 4,334,012. Preferably, at the start of the ultrafiltration, pH and pAg are the same as at the end of the precipitation without any adjustment.

Besides these previously mentioned dialysis techniques like ultrafiltration flocculation by polymeric reagents at a pH value below 4.0, followed by washing and redispersion may be applied. Emulsion washing has e.g. described in Research Disclosure N° 36544 (1994), Chapter III.

As a result according to the present invention a photosensitive emulsion prepared by the method according to present invention as described hereinbefore is thus provided.

The size distribution of the {100} tabular silver halide particles rich in silver bromide of the photographic emulsions thus obtained can be monodisperse or heterodisperse as already set forth hereinbefore.

Two or more types of tabular silver halide emulsions that have been prepared differently, wherein at least one has been preprared according to the method of the present invention can be mixed for forming a photographic emulsion for use in practically useful materials.

Before use in such practically useful materials, said tabular silver halide emulsions rich in silver bromide prepared by the method of the present invention can be chemically sensitized as described e.g. in "Chimie et Physique Photographique" by P. Glafkides, in "Photographic Emulsion Chemistry" by G. F. Duffin, in "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). Chemical sensitisation has e.g. also been described in Research Disclosure N° 36544 (1994) and 38957 (1996), Chapter IV.

As described in said literature chemical sensitization can be carried out by effecting the ripening in the presence of small amounts of compounds containing sulphur e.g. thiosulphate, thiocyanate, thioureas, sulphites, mercapto compounds, and rhodamines. Said compounds containing sulphur can also be, at least partially, replaced by compounds containing selenium and/or tellurium. The emulsions may be sensitized also by means of gold-sulphur, gold-sulphur-selenium, gold-selenium ripeners or by means of reductors e.g. tin compounds as described in GB-A 789,823, amines, hydrazine derivatives, formamidine-sulphinic acids, and silane compounds. Particularly useful chemical sensitizers have been disclosed in DE's 1 96 19443, 1 95 25036, 4 434 971 and in EP-A's 0 862 088 and 0 895 121.

The {100} tabular silver halide emulsions rich in silver bromide may be spectrally sensitized with methine dyes such as those described by F. M. Hamer in "The Cyanine Dyes and Related Compounds", 1964, John Wiley & Sons and in Research Disclosures Nos. 36544 (1994) and 38957 (1996), Chapter V. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes. A survey of useful chemical classes of spectral sensitizing dyes and specific useful examples in connection with tabular grains is given in the already cited Research Disclosure Item 22534. Oxacarbocyanines have been described e.g. in U.S. Pat. No. 5,434,042. Especially preferred green sensitizers in connection with the present invention are anhydro-5,5'-dichloro-3,3'-bis(n.sulfobutyl)-9-ethyl-oxacarbocyanine hydroxide and anhydro-5,5'-dichloro-3,3'-bis(n.sulfopropyl)-9-ethyl-oxacarbocyanine hydroxide. Imidacarbocyanines as e.g. those described in Research Disclosure N° 37312 (1995) may be useful as well as combinations of oxacarbocyanines and imidacarbocyanines as in EP-A 0 590 593 from the viewpoint of sensitivity as well as from the viewpoint of decoloring properties and stain removal in the processing of materials containing spectrally sensitized tabular grains rich in silver bromide as in the present invention. Other very useful spectral sensitizers are those described in EP-Application No. 98200061, filed Jan. 13, 1998.

Just as in classical emulsion preparation wherein spectral sensitization traditionally follows the completion of chemical sensitization the same method may be applied with respect to {100} tabular grains prepared according to the method of the present invention. Although in connection with {111} tabular grains, it is specifically considered that spectral sensitization may occur simultaneously with or may even precede completely the chemical sensitization step this is not required for {100} tabular grains for the same reasons as set forth in the background of the invention.

The chemical sensitization of {100} tabular grains rich in silver bromide prepared according to the method of the present invention may proceed in the presence of one or more phenidone and derivatives, a dihydroxy benzene as hydroquinone, resorcinol, catechol and/or a derivative(s) therefrom, one or more stabilizer(s) or antifoggant(s), one or more spectral sensitizer(s) or combinations of said ingredients. Especially 1-p-carboxyphenyl, 4,4' dimethylpyrazolidine-3-one may be added as a preferred auxiliary agent.

The gelatinous silver halide emulsion having {100} tabular grains rich in silver bromide prepared according to the method of the present invention is further characterized by the presence of amino-modified polyvinyl alcohol in minor amounts versus gelatin, as more gelatin has been added before grain growth, and before redispersion of the flocculated emulsion. For the emulsion ready-for-addition to coating solutions after redispersion, chemical ripening and spectral sensitization typical ratios by weight of gelatin to silver, expressed as an equivalent amount of silver nitrate, are from 0.2 up to 0.5 and more preferably from 0.25 up to 0.40.

The emulsion according to the present invention is thus ready for being coated in hydrophilic layer(s) which may, just as non-light-sensitive layers of the photographic material comprise compounds preventing the formation of fog or stabilizing the photographic characteristics during the production or storage of the photographic elements or during the photographic treatment thereof. Many known compounds can be added as fog-inhibiting agent or stabilizer to the silver halide emulsion layer or to other coating layers in water-permeable relationship therewith such as an undercoat or a protective layer. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles (preferably 5-methylbenzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JP-A. 75/39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid and benzenethiosulphonic acid amide. Other compounds that can be used as fog-inhibiting compounds are those described in Research Disclosure N° 17643 (1978), Chapter VI and in RD's Nos 36544 (1994) and 38957 (1996), Chapter VII. Many of these fog-inhibiting compounds may have been already added during the chemical ripening of the tabular silver halide crystals rich in silver bromide.

It is clear that additional gelatin is further added in order to establish optimal coating conditions and/or to establish the required thickness of the coated emulsion layer. Preferably a gelatin to silver halide ratio increase in the range from 0.3 to 1.0 is then obtained, wherein extra gelatin added is not required to have a composition as in the preparation step of the grains according to the method of the present invention or during redispersion of the flocculated emulsion. Another binder may also be added instead of or in addition to gelatin. Useful vehicles, vehicle extenders, vehicle-like addenda and vehicle related addenda have been described e.g. in Research Disclosure Nos. 36544 (1994) and 38957 (1996), Chapter II. Gelatin added after precipitation is not considered to be a protective colloid as it is not directly adsorbed onto the surface of the {100} tabular crystals rich in silver bromide, prepared according to the present invention, but it is merely considered as a (hydrophilic colloidal) binder. The said binder of the photographic material having at least one gelatinous emulsion according to the present invention in one or more hydrophilic light-sensitive emulsion layer(s) can be forehardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methylol-dimethylhydantoin, dioxan derivatives e.g. 2,3-dihydroxy- dioxan, active vinyl compounds e.g. 1,3,5-tri-acryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143.

The gelatinous photosensitive emulsions comprising {100} tabular grains rich in silver bromide of the present invention can be used in various types of photographic elements, e.g. black-and-white silver halide photographic materials, like materials used for X-ray diagnostic purposes, for micrographic applications or color sensitive materials.

Photographic materials according to the present invention thus comprise a support and on one or on both sides thereof one or more light-sensitive silver halide emulsion layer(s) coated from a photosensitive emulsion according to the present invention. In a preferred embodiment said photographic materials are single-side or double-side coated radiographic materials. Single-side coated materials are e.g. used in mammographic applications, normally in combination with one intensifying screen at the light-sensitive side of the support in order to get irradiated, without loss in sharpness or detail (e.g. in order to unambiguously detect microcalcifications), by exposure to luminescent phosphors of the screen after exposure to X-rays. Double side-coated X-ray materials are used in diagnostic applications wherein more speed is required (as e.g. for diagnosis of the thorax) and wherein slight loss in sharpness due to cross-over is still acceptable inasmuch as it is not detremendous for the diagnosis. It is clear that from the viewpoint of cost and environmental considerations after use, coated amounts of silver are reduced by the manufacturer up to the lowest acceptable level (e.g. up to at most 3 $g/m^2$ of silver and per side, said amount expressed as an equivalent amount of silver nitrate although amounts of up to 7 $g/m^2$ and per side and even up to 10 $g/m^2$ are not exceptional). The coated amount of silver is highly dependent from the required sensitivity or speed of the material and of the required image quality which is directly related with the maximum thickness of the coated layers in the materials, or silver load directly depends on the application as such. So e.g. X-ray materials for non-destructive purposes require high amounts of silver as these materials should be sensitive to direct-X-ray exposure.

The single-side or double side coated X-ray materials may contain one single photosensitive emulsion layer, as it is the case for many applications, or it can be built up by two or even more emulsion layers as has e.g. been illustrated in EP-A 0 770 909 and in EP-A 0 890 875. Emulsions of the present invention are advantageously used therein.

According to the present invention a material with a single or a duplitized photosensitve emulsion layer coated on one or both sides of the support thus contains at least one gelatinous tabular {100} silver halide emulsion according to the present invention.

By making use of duplitized emulsions differing in photographic speed by at least 0.15 log E a gain in cross-over exposure (and thus sharpness or image definition) in double side coated materials can be obtained. In the case of color photography the material contains blue, green and red sensitive layers each of which can be single coated, but merely consist of double or even triple layers. Besides the light sensitive emulsion layer(s) the photographic material may contain several light-insensitive layers, e.g. a protective layer, one or more backing layers, one or more subbing layers, one or more intermediate layers e.g. filter layers and even an afterlayer containing e.g. the hardening agent(s), the antistatic agent(s), filter dyes for safety-light purposes, etc.

The photographic element of the present invention may further comprise various kinds of coating physical property modifying addenda as described in RD Nos. 36544 (1994) and 38957 (1996), Chapter IX, wherein coating aids, plasticizers and lubricants, antistats and matting agents have been described. Development acceleration can be accomplished by incorporating in the emulsion layer or adjacent layers various compounds, preferably polyalkylene derivatives having a molecular weight of at least 400 such as those described in e.g. U.S. Pat. Nos. 3,038,805; 4,038,075 and 4,292,400 as well as in EP-A's 0 634 688 and 0 674 215.

The photographic element of the present invention may further comprise various other additives such as e.g. compounds improving the dimensional stability of the photographic element, UV-absorbers, spacing agents and plasticizers. Suitable additives for improving the dimensional stability of the photographic element are e.g. dispersions of a watersoluble or hardly soluble synthetic polymer e.g. polymers of alkyl(meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl (meth)acrylates, sulphoalkyl (meth)acrylates, and styrene sulphonic acids.

Suitable UV-absorbers are e.g. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. Nos. 3,705,805 and 3,707,375, butadiene compounds as described in U.S. Pat. No. 4,045,229, and benzoxazole compounds as described in U.S. Pat. No. 3,700,455 and those described in RD Nos. 36544 (1994) and 38957 (1996), Chapter VI, wherein also suitable optical brighteners are mentioned. UV-absorbers are especially useful in color materials where they prevent the fading by light of the color images formed after processing.

Spacing agents can be present of which, in general, the average particle size is comprised between 0.2 and 10 μm. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of polymethyl methacrylate, of copolymers of acrylic acid and methyl methacrylate, and of hydroxypropylmethyl cellulose hexahydrophthala-te. Other suitable spacing agents have been described in U.S. Pat. No. 4,614,708.

The photographic material can contain several non-light sensitive layers, e.g. an antistress topcoat layer, one or more backing layers in case of single-side coated materials, and one or more intermediate layers eventually containing filter- or antihalation dyes that absorb scattering light and thus promote image sharpness. Suitable light-absorbing dyes used in these intermediate layers are described in e.g. U.S. Pat. Nos. 4,092,168; 4,311,787; 5,380,634; 5,344,749; 5,478,708; 5,502,205; in EP-A's 0 586 748, 0 786 497, 0 781 816, 724 191, in DE 2,453,217, and in GB-A 7,907,440. Situated in such an intermediate layer between the emulsion layers and the support there will be only a small negligable loss in sensitivity but in rapid processing conditions decoloration of the filter dye layers may form a problem. Therefor it should be recommended to decrease the thickness of the totally coated layer, resulting in shorter drying times after washing in the processing cycle. Alternatively the use of intermediate layers situated between emulsion layer(s) and support, reflecting the fluorescent light emitted by the screens may bring a solution. As the light emitted from the screens by the phosphors incorporated therein is a very important source of light-scattering the addition of appropriate filter dyes to the screens may be recommended. In the presence in the screens of e.g. green light-emitting phosphors use may be made of specific dyes as MAKROLEX ORANGE G or GG, trademarked products of BAYER AG.

One or more backing layers can be provided at the non-light sensitive side of the support of materials coated with at least one emulsion layer at only one side of the support. These layers which can serve as anti-curl layer can contain e.g. matting agents like silica particles, lubricants, antistatic agents, light absorbing dyes, opacifying agents, e.g. titanium oxide and the usual ingredients like hardeners and wetting agents.

The support of the photographic material may be opaque or transparent, e.g. a paper support or resin support. When a paper support is used preference is given to one coated at one or both sides with an a-olefin polymer, e.g. a polyethylene layer which optionally contains an antihalation dye or pigment. It is also possible to use an organic resin support e.g. cellulose nitrate film, cellulose acetate film, poly(vinyl acetal) film, polystyrene film, poly(ethylene terephthalate) or poly(ethylene naphthalate) film, polycarbonate film, polyvinylchloride film or poly-α-olefin films such as polyethylene or polypropylene film. The thickness of such organic resin film is preferably comprised between 0.07 and 0.35 mm. These organic resin supports are preferably coated with a subbing layer which can contain water insoluble particles such as silica or titanium dioxide.

The photographic material of the present invention containing in at least one photosensitive layer {100} tabular emulsion grains prepared according to the present invention can be image-wise exposed by any convenient radiation source in accordance with its specific application (as e.g. color photography, black-and-white photographic materials for medical diagnosis irradiated by X-rays non-destructive testing materials irradiated by direct X-rays; black-and-white materials for graphic or micrographic applications, etc.).

Of course processing conditions and composition of processing solutions are dependent from the specific type of photographic material in which the tabular grains prepared according to the present invention are applied.

For example, in a preferred embodiment of materials for X-ray diagnostic purposes said materials may be adapted to rapid processing conditions. Preferably an automatically operating processing apparatus is used provided with a system for automatic regeneration of the processing solutions.

The forehardened material may be processed using one-part package (hardener-free) chemistry or three-part package (hardener-containing) chemistry, depending on the processing application determining the degree of hardening required in said processing cycle. Applications within total processing times of 30 seconds and lower up to 90 seconds, known as common praxis, are possible. From an ecological point of view it is e.g. possible to use sodium thiosulphate instead of ammonium thiosulphate in the fixer and ascorbic acid, reductic acid or derivatives therefrom in the developer as has e.g. been disclosed in EP-A 0 732 619 and in U.S. Pat. Nos. 5,593,817 and 5,604,082.

By the preparation method of the present invention a silver halide emulsion is thus provided with silver halide crystals rich in silver bromide having a tabular {100} crystal habit, wherein tabular grains are present in high amounts, thus covering a high percentage projected area of all grains according to the object of the present invention.

Having described in detail preferred embodiments of the current invention, it will now be apparent to those skilled in the art that numerous modifications can be made therein without departing from the scope of the invention as defined in the following claims.

EXAMPLE.

Preparation of Emulsion A (comparative emulsion)

3000 ml of a dispersion medium (C) containing 5.5 g of oxidized gelatin containing 1074 ppm of methionine was provided in a stirred reaction vessel. The pBr was adjusted with potassium bromide to a value of 2.39; pH was adjusted to a value of 1.8 and the reaction vessel was held at a constant temperature of 51° C.

While vigourously stirring this solution, 8 ml of a 1.96 molar solution of silver nitrate and 8 ml of a 1.96 molar solution of potassium bromide were added simultaneously by double jet precipitation in a time interval of 30 s.

After a physical ripening time of 90 seconds the temperature was increased up to 70° C. within a time interval of 25 minutes.

After 5 minutes 500 ml of a 10% aqueous gelatinous solution was added to the reaction vessel and 5 minutes later a first neutralization step was performed by addition of the 1.96 molar solution of potassium bromide within a time interval of 330 s at a rate of 7.5 ml/min.

A second neutralization step was further performed by double jet precipitation of the 1.96 molar solutions of silver nitrate and potassium bromide, wherein the silver nitrate solution was added during 60 s at a rate of 7.5 ml/min., while adding potassium bromide in order to maintain the potential value at 0 mV vs. a saturated calomel electrode.

Further crystal growth was provided by an accelerated addition of 510 ml of the silver nitrate solution in 2002 s, wherein the addition rate was three times higher at the end of the growth step than at the beginning. The potassium bromide solution was added at a rate in order to maintain the constant potential at a value of 0 mV.

After another physical ripening time of 5 minutes a third neutralization step was performed by addition of the silver nitrate solution at a rate of 7.5 ml/min. during 440 s.

A fourth neutralization step was further performed by double jet precipitation of the 1.96 molar solutions of silver nitrate and potassium bromide, wherein the silver nitrate solution was added during 100 s at a rate of 7.5 ml/min., while adding potassium bromide in order to maintain the potential value at 100 mV vs. a saturated calomel electrode.

In a second growth step 907 ml of the silver nitrate solution were added in 2456 s at a starting velocity of 7.5 ml/min. up to a maximum rate of 36.9 ml/min. at the end of precipitation, while simultaneously adding a solution of 1.93 molar of potassium bromide and 0.03 molar of potassium iodide at a continously varying rate in order to maintain the potential at a value of 100 mV throughout the whole second growth step.

After flocculation by acifidification of the vessel wherein polystyrene sulphonic acid was added and after washing and redispersing the silver bromoiodide emulsion crystals having a composition of 99 mole % of silver bromide and 1 mole % of silver iodide were evaluated by electron microscopic techniques: more than 95% of the said grains had a tabular crystal habit, with an average thickness of 0.180 μm and an average equivalent volume diameter, defined as diameter of a sphere having the same volume of the flat crystals of 0.75 μm.

The replicas made by electron microscopic techniques from the grains of this comparative emulsion are represented in FIG. 1 and are illustrative for the presence of high amounts of crystals showing a {111} tabular crystal habit.

Preparation of Emulsion B (inventive emulsion)

The same preparation method was performed as was made hereinbefore in order to obtain the comparative Emulsion A, except for the addition of 2 g of polymer P-1 to the reaction vessel before starting precipitation. Said polymer P-1 had the same general formula as in formula (I) presented in the detailed description, but wherein in the case of P-1 polyvinylalcohol was modified in such a way that, expressed in weight % 90% was present as vinylalcohol and 10% as vinylacetalamine dimethylacetal.

Figure 2:
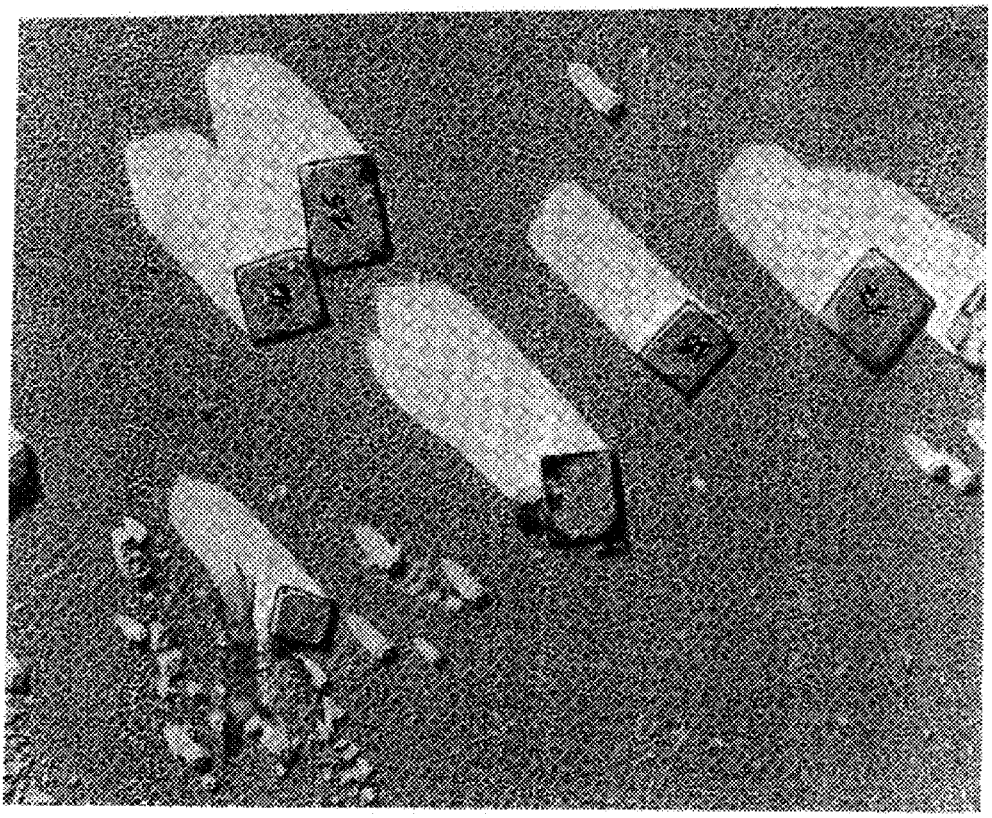

The silver bromoiodide emulsion crystals having a composition of 99 mole % of silver bromide and 1 mole % of silver iodide as well were evaluated by electron microscopic techniques: more than 50% of the said grains had a tabular crystal habit and an average equivalent volume diameter of 0.70 μm. The replicas made from grains of this emulsion are represented in FIG. 2 and are illustrative for the presence of crystals showing a {100} tabular crystal habit and an aspect ratio of more than 1.5 for a total projective surface of more than 50% of the projective surface of all grains, whereas less than 5% of the said surface are occupied by {111} tabular grains having an aspect ratio of more than 2.

Preparation of Emulsion C (inventive emulsion)

The same preparation was performed as was made hereinbefore in order to obtain the inventive Emulsion B, except for the addition of 2 g of polymer P-2 to the reaction vessel before starting precipitation. Said polymer P-2 had the same general formula as in formula (I) presented in the detailed description, but wherein in the case of P-2 polyvinylalcohol was modified in such a way that, expressed in % by weight 67% was present as vinylalcohol and 33% as vinylacetalamine dimethylacetal.

The silver bromoiodide emulsion crystals having a composition of 99 mole % of silver bromide and 1 mole % of silver iodide as well were evaluated by electron microscopic techniques: more than 50% of the said grains had a tabular crystal habit and an average equivalent volume diameter of 0.76 μm.

The replicas represented in the FIG. 1 (comparative) and in FIG. 2 (inventive) respectively thus clearly show the difference in crystal habit of the tabular emulsion crystals of the tabular silver bromoiodide grains.

It is clear that as has been illustrated in the example that only slightly modifying the composition of the reaction vessel before starting nucleation, in that an aqueous soluble polymer as an amino-modified polyvinyl alcohol having mixing compatibility with aqueous gelatinous solutions is able to make the crystal habit of tabular grains rich in silver bromide change from a predominantly {111} crystal habit to a predominantly {100} crystal habit, wherein tabular grains are present in high amounts, thus covering a high percentage projected area of all grains as was the object of the present invention and as is expressed in the claims hereinafter.

What is claimed is:

1. Method of preparing a photosensitive emulsion comprising tabular silver halide grains rich in silver bromide, having {100} major faces and an aspect ratio more than 1.5, wherein at least 50% of the projected area of all grains is provided by said {100} tabular grains, said method comprising the step of running in a reaction vessel an aqueous silver salt solution and an aqueous alkali halide solution rich in alkali bromide, characterized in that before starting running the said reaction vessel comprises in an aqueous solution of gelatin an amount of amino-modified polyvinyl alcohol, wherein in said aqueous solution the ratio by weight of said amino-modified polyvinyl alcohol to gelatin is at least 1:5 and an upper limit of said ratio is 1:1, and wherein said gelatin is oxidized gelatin, having methionine in an amount of less than 30 μmoles per mole of gelatin.

2. Method according to claim 1, wherein in said aqueous solution the ratio by weight of said amino-modified polyvinyl alcohol to gelatin is at least 1:3 and said upper limit of said ratio is 1:1.

3. Method according to claim 1, wherein in said amino-modified polyvinyl alcohol the ratio by weight of vinylacetal amine dimethylacetal to vinylalcohol is from 1:20 up to 1:1.

4. Method according to claim 1, wherein in said amino-modified polyvinyl alcohol the ratio by weight of vinylacetal amine dimethylacetal to vinylalcohol is from 1:10 up to 1:2.

5. Method according to claim 1, wherein said grains rich in silver bromide are composed of silver bromide, silver bromoiodide, silver bromochloride or silver bromochloroiodide, wherein iodide, if present, represents a percentage molar amount of up to 3 mole % and wherein chloride, if present, represents a percentage molar amount of up to 10 mole %.

6. Photosensitive emulsion prepared by the method according to claim 1.

7. Photographic material comprising a support and on one or on both sides thereof one or more light-sensitive silver halide emulsion layer(s) coated from a photosensitive emulsion according to claim 6.

8. Photographic material according to claim 7, wherein said photographic material is a single-side or double-side coated radiographic material.

* * * * *